US009449535B2

(12) United States Patent
Henderson

(10) Patent No.: US 9,449,535 B2
(45) Date of Patent: Sep. 20, 2016

(54) LABEL ASSEMBLY AND METHOD OF DISPENSING LOW-STIFFNESS LABELS

(71) Applicant: Avery Dennison Corporation, Glendale, CA (US)

(72) Inventor: Kevin O. Henderson, Willoughby Hills, OH (US)

(73) Assignee: Avery Dennison Corporation, Glendale, CA (US)

( * ) Notice: Subject to any disclaimer, the term of this patent is extended or adjusted under 35 U.S.C. 154(b) by 0 days.

(21) Appl. No.: 14/519,570

(22) Filed: Oct. 21, 2014

(65) Prior Publication Data

US 2015/0107140 A1 Apr. 23, 2015

Related U.S. Application Data

(60) Provisional application No. 61/893,427, filed on Oct. 21, 2013.

(51) Int. Cl.

| | |
|---|---|
| ***G09F 3/10*** | (2006.01) |
| ***G09F 3/02*** | (2006.01) |
| ***G09F 3/00*** | (2006.01) |

(52) U.S. Cl.

CPC . *G09F 3/10* (2013.01); *G09F 3/02* (2013.01); *G09F 3/0286* (2013.01); *G09F 2003/023* (2013.01); *G09F 2003/0229* (2013.01); *G09F 2003/0245* (2013.01); *G09F 2003/0255* (2013.01)

(58) Field of Classification Search

CPC ..... G09F 2003/0227; G09F 2003/0245

See application file for complete search history.

(56) References Cited

U.S. PATENT DOCUMENTS

| | | | | |
|---|---|---|---|---|
| 3,985,826 A | | 10/1976 | Futamura | |
| 4,950,518 A | | 8/1990 | Walliser | |
| 5,201,976 A | * | 4/1993 | Eastin | 156/152 |
| 5,458,938 A | * | 10/1995 | Nygard et al. | 428/40.2 |
| 5,708,083 A | | 1/1998 | Kawamura et al. | |
| 5,756,173 A | | 5/1998 | Tung et al. | |
| 5,824,183 A | | 10/1998 | Crankshaw | |

(Continued)

FOREIGN PATENT DOCUMENTS

| | | |
|---|---|---|
| EP | 0031383 | 7/1981 |
| EP | 0252739 | 1/1988 |

(Continued)

OTHER PUBLICATIONS

International Search Report and Written Opinion issued in corresponding IA No. PCT/US2014/061502 dated Feb. 12, 2015.

(Continued)

*Primary Examiner* — Kristina Junge

(74) *Attorney, Agent, or Firm* — Avery Dennison Corporation

(57) ABSTRACT

A label assembly having a first configuration comprising a facestock layer having an upper surface and a lower surface, an adhesive layer having an upper surface and a lower surface, the upper surface of the adhesive disposed adjacent to the lower surface of the facestock layer, a tack varnish layer overlying the upper surface of the facestock, a liner assembly comprising a release liner overlying the adhesive layer, the release liner comprising a liner layer having an upper surface and a lower surface, the upper surface comprising a release coating layer, the release coating layer being disposed adjacent to the adhesive layer, and a tack coating layer overlying the lower surface of the liner layer.

33 Claims, 8 Drawing Sheets

(56) References Cited

U.S. PATENT DOCUMENTS

| | | | | |
|---|---|---|---|---|
| 6,033,725 | A | 3/2000 | Moeller et al. | |
| 6,110,552 | A | 8/2000 | Casey et al. | |
| 6,110,554 | A | 8/2000 | Moeller et al. | |
| 6,403,190 | B1 | 6/2002 | Casey et al. | |
| 6,812,292 | B2 | 11/2004 | Terano et al. | |
| 7,201,202 | B2 | 4/2007 | Ensign, Jr. | |
| 7,270,874 | B2 | 9/2007 | Dalgleish | |
| 7,399,509 | B2 | 7/2008 | Virtanen | |
| 7,473,454 | B2 | 1/2009 | Virtanen | |
| 7,802,602 | B2 | 9/2010 | Siedlaczek | |
| 8,017,207 | B2 | 9/2011 | Hacikyan | |
| 2005/0142319 | A1 | 6/2005 | Virtanen | |
| 2007/0039684 | A1 | 2/2007 | Nedblake | |
| 2008/0113150 | A1 | 5/2008 | Lee | |
| 2009/0017241 | A1* | 1/2009 | Sakuma et al. | 428/35.4 |
| 2009/0188613 | A1 | 7/2009 | Fearn | |
| 2012/0082816 | A1 | 4/2012 | Wada et al. | |
| 2012/0082817 | A1 | 4/2012 | Wada et al. | |
| 2012/0082818 | A1 | 4/2012 | Wada et al. | |
| 2013/0175289 | A1 | 7/2013 | Sternberg | |

FOREIGN PATENT DOCUMENTS

| | | |
|---|---|---|
| EP | 0876960 | 11/1998 |
| EP | 1072663 | 1/2001 |
| EP | 2646240 | 6/2012 |
| EP | 2488417 | 8/2012 |
| GB | 2464218 | 4/2010 |
| JP | 11-323280 | 11/1999 |
| JP | 2011-037491 | 2/2011 |
| WO | 02/055295 | 7/2002 |
| WO | 2011/045587 | 4/2011 |
| WO | 2012/009755 | 1/2012 |
| WO | 2012/072889 | 6/2012 |
| WO | 2012/127121 | 9/2012 |
| WO | 2013/001194 | 1/2013 |
| WO | 2013/011193 | 1/2013 |
| WO | 2013/140035 | 9/2013 |

OTHER PUBLICATIONS

International Preliminary Report on Patentability issued in corresponding IA No. PCT/US2014/035462 dated Oct. 27, 2015.

International Search Report and Written Opinion issued in corresponding IA No. PCT/US2014/035462 dated Sep. 16, 2014.

Qin, Dong, et al., "Soft lithography for micro- and nanoscale patterning," Nature Protocols, vol. 5, No. 3, pp. 491-502, published online Feb. 18, 2010.

Thanh-Vinh, N., et al., "Micro suction cup array for wet-dry adhesion," MEMS 2011, Cancum, Mexico, Jan. 23-27, 2011, pp. 284-287.

"Create arrays of micro-scale shapes, lenses, patterns, and structures more quickly and at lower cost than with conventional photolithography, for shortened development time," Tech of the Week, yet2.com, Oct. 13, 2013.

* cited by examiner

LABEL ASSEMBLY AND METHOD OF DISPENSING LOW-STIFFNESS LABELS

CROSS-REFERENCE TO RELATED APPLICATION

The present application claims the benefit of U.S. Provisional Application No. 61/893,427 filed Oct. 21, 2013, which is incorporated herein by reference in its entirety.

BACKGROUND

Typical labels, including pressure sensitive labels, are manufactured from label stock that comprises a face layer (facestock), an adhesive (i.e., PSA) layer adhered to the face layer and a protective release liner removably adhered to the adhesive layer. The label stock is generally provided in roll form. Individual labels may be produced by die cutting the face layer and the PSA layer, and then removing the surrounding waste matrix, leaving the individual labels adhered to the release liner.

Thin labels and highly conformable layers are often difficult to dispense by a standard peel plate method. This limits options for designing labels by decreasing caliper or improving conformability by using a more elastic label.

SUMMARY

The present invention provides a label assembly. In one aspect, the present invention provides a label assembly with a relatively low stiffness. The present invention further provides a method for creating a label with the adhesive side facing outward. This increases the options on applying low-stiffness labels, as the thickness or stiffness of the label would become less relevant. Further, this invention allows for reductions in liner and facestock materials (within the limits of the technology to die cut a thin construction).

In one aspect, the present invention provides a label assembly having a first configuration comprising a facestock layer having an upper surface and a lower surface, an adhesive layer having an upper surface and a lower surface, the upper surface of the adhesive disposed adjacent to the lower surface of the facestock layer, a tack varnish layer overlying the upper surface of the facestock, a liner assembly comprising a release liner overlying the adhesive layer, the release liner comprising a liner layer having an upper surface and a lower surface, the upper surface comprising a release coating layer, the release coating layer being disposed adjacent to the adhesive layer, and a tack coating layer overlying the lower surface of the liner layer.

In another aspect, the present invention provides a label assembly comprising a release liner, the release liner comprising a liner layer having an upper surface and a lower surface, the upper surface disposed adjacent to a release coating layer, and a tack coating layer disposed adjacent to the lower surface of the liner layer, a facestock layer underlying the liner layer, the facestock layer having an upper surface and a lower surface, an adhesive layer underlying the liner layer, the adhesive layer having an upper surface and a lower surface, the upper surface of the adhesive disposed adjacent to the lower surface of the facestock layer, a tack varnish layer overlying the upper surface of the facestock layer and disposed adjacent to the tack coating layer.

The present invention also provides a method for applying a label to a substrate comprising providing a label assembly having a first configuration comprising a facestock layer having an upper surface and a lower surface, an adhesive layer having an upper surface and a lower surface, the upper surface of the adhesive disposed adjacent to the lower surface of the facestock layer, a tack varnish layer overlying the upper surface of the facestock, a liner assembly comprising a release liner overlying the adhesive layer, the release liner comprising a liner layer having an upper surface and a lower surface, the upper surface comprising a release coating layer, the release coating layer being disposed adjacent to the adhesive layer; and a tack coating layer overlying the lower surface of the liner layer. The label assembly is wound into a roll such that the tack varnish layer contacts the tack coating layer; wherein the tack coating layer and the tack varnish layer exhibit a bond force greater than a bond force between the release coating layer and the adhesive. Next, the label assembly is unwound and the bond force between the tack coating layer and the tack varnish layer results in a release of the bond between the adhesive layer and the low release coating layer such that the adhesive layer is facing outward. The label is applied by contacting a surface of the adhesive layer with a target substrate surface, and a bond force between the target substrate and the adhesive layer greater than the bond force between the tack coating layer and the tack varnish layer, such that the release liner is removable from the label assembly.

The drawings are for purposes of illustrating aspects and embodiments of the invention and are not intended to limit the invention to those specific embodiments. Unless specified otherwise, the figures are not drawn to scale. Aspects of the invention may be further understood with reference to the drawings and the following description.

DETAILED DESCRIPTION

The present technology provides a label assembly that allows for improved application or dispensing of low stiffness or highly conformable labels to be applied to a target substrate. The present invention also provides a system and method for the formation of such labels.

Figure 1:
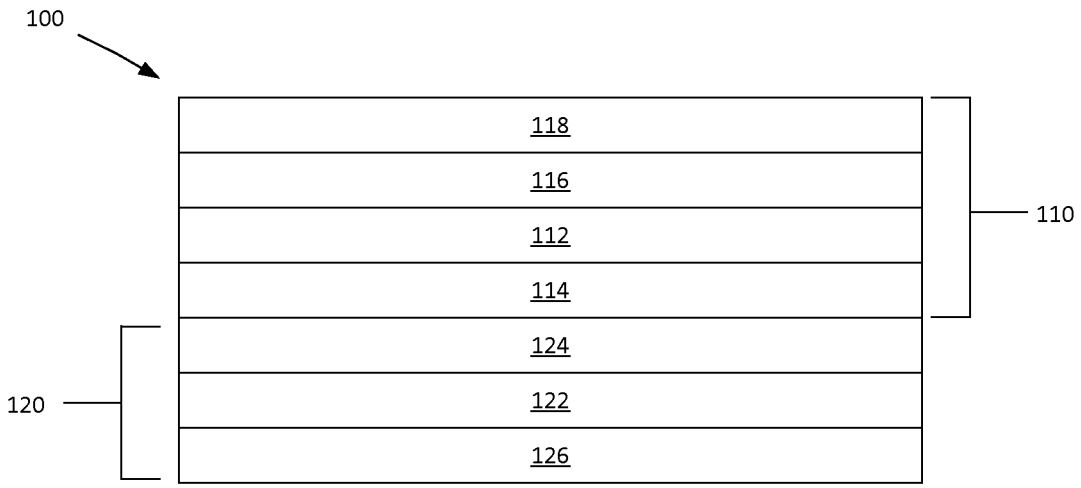
FIG. 1 is a schematic cross-sectional view of a label assembly according to one embodiment of the present invention.

In one embodiment, a label assembly is provided having a first configuration 100. The label assembly 100 comprises a label section 110 and a release liner section 120. The label section 110 comprises a facestock layer 112, an adhesive layer 114 disposed on a lower surface of the facestock layer 112, an optional print surface 116 disposed on an upper surface of the facestock layer 112, and a tack varnish layer 118 overlying the optional print surface 116 and upper surface of the facestock layer 112. The liner section 120 comprises a liner layer 120 having an upper surface and a lower surface, a release coating layer 124 disposed on the upper surface of the liner layer 122, and a tack coating layer 126 disposed on the lower surface of the liner layer 122. In the pre-wound form as depicted in FIG. 1, the release coating layer 124 is disposed adjacent to the adhesive layer 114.

Figure 2:
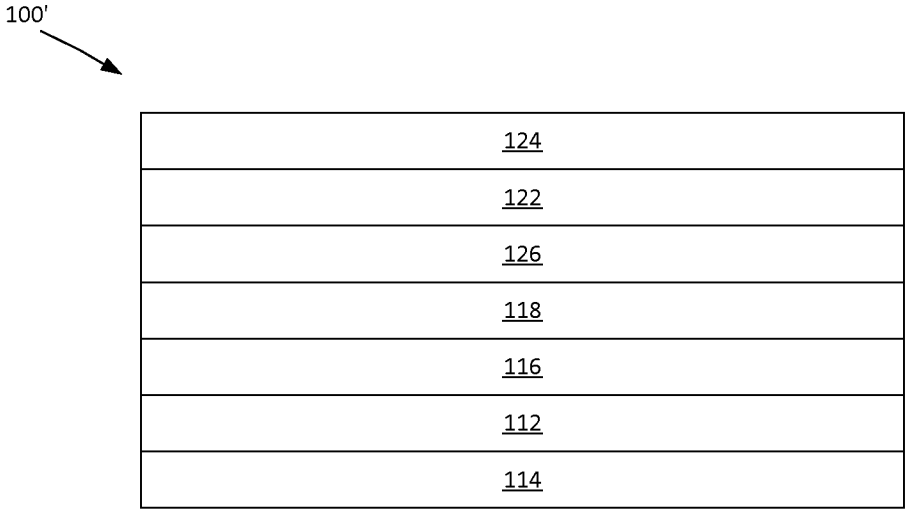
FIG. 2 is a cross-sectional view of the label assembly of FIG. 1 after being unwound from a roll.

When the label assembly 100 is wound into a roll, the tack coating layer 126 contacts the tack varnish layer 118. The tack coating layer 126 and the tack varnish layer 118 are provided such that the bonding force between the tack coating layer 126 and the tack varnish layer 118 is greater than the bonding force between the adhesive layer 114 and the release coating layer 124. When the roll is unwound, the adhesive layer 114 separates from the release coating/liner layer 122/124 and the tack varnish layer 118 and the tack coating layer 126 remain bonded together, which results in the label assembly having a second configuration 100' having the adhesive layer 114 facing outwardly as shown in FIG. 2.

Figure 3:
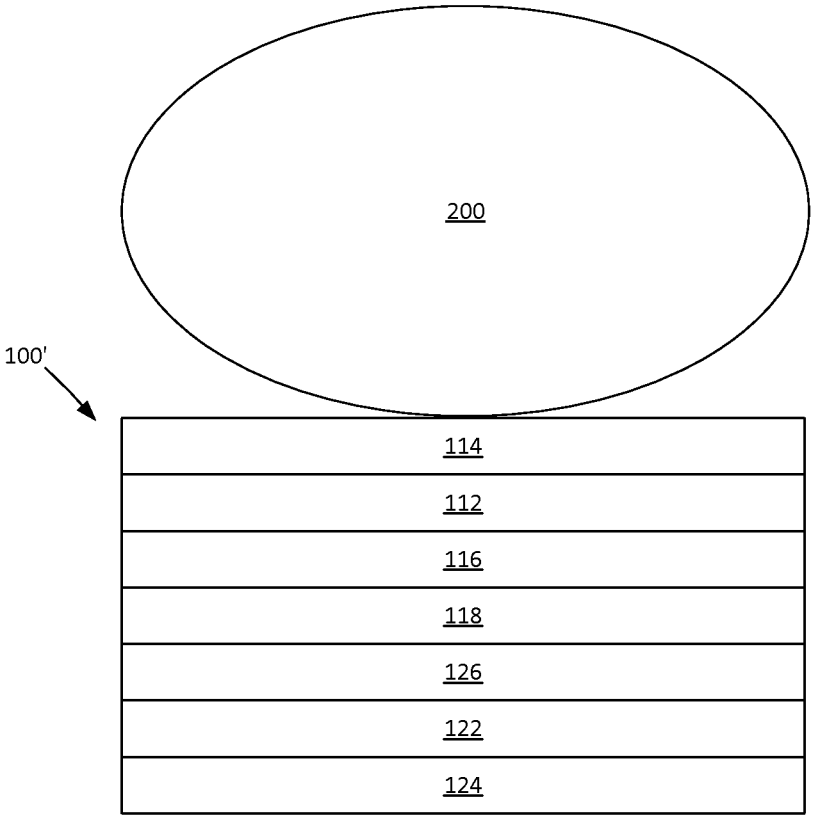
FIGS. 3 and 4 are schematic illustrations of aspects of applying a label, in accordance with aspects of the invention to a target substrate.
Figure 4:
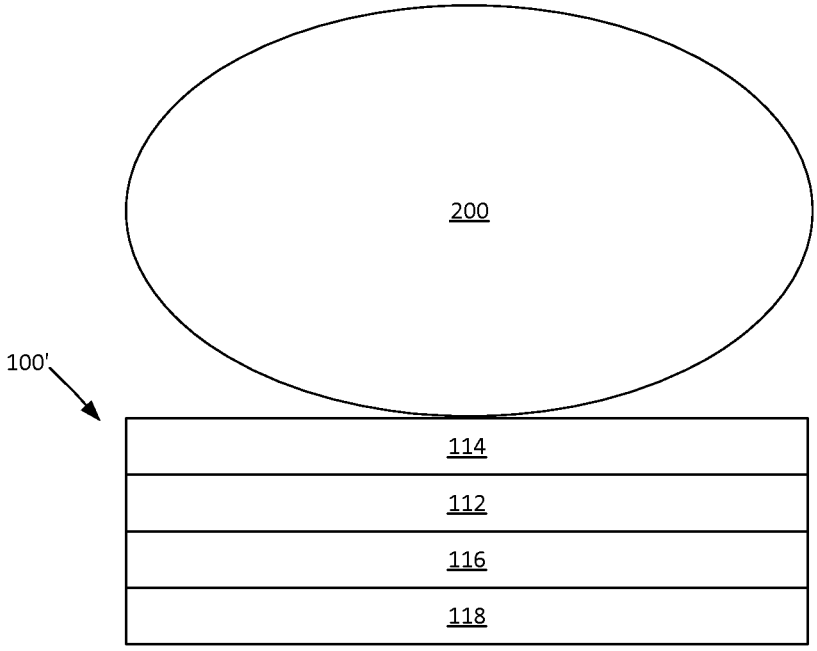

The label assembly 100' can be cut to provide labels having a size and configuration as desired for a particular purpose or intended use. Referring to FIG. 3, to apply the label assembly 100' to a substrate, the exposed adhesive layer 114 surface is brought into contact with a target substrate 200. The label assembly 100' is provided such that the bond strength between the adhesive layer 114 and the substrate 200 is greater than the bond strength between the tack coating layer 126 and the tack varnish layer 118, such that the release liner section 120 can be removed from the adhesive section to provide a labeled substrate as shown in FIG. 4.

Figure 5:
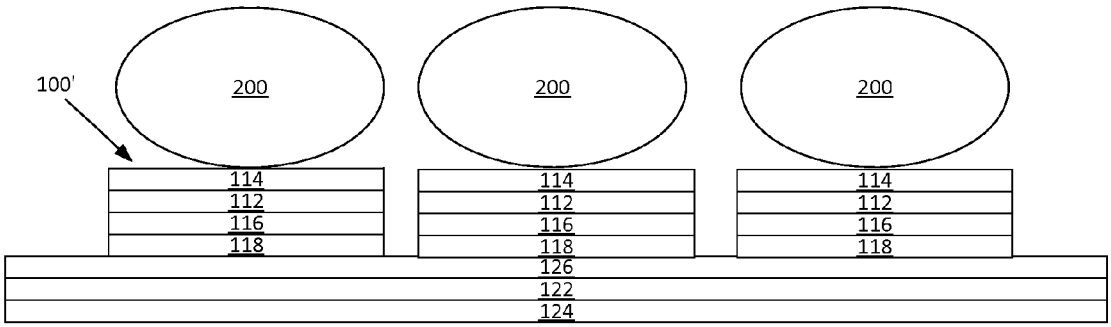
FIGS. 5 and 6 illustrate aspects of applying labels cut from a roll of an adhesive in accordance with the embodiments of the present invention.
Figure 6:
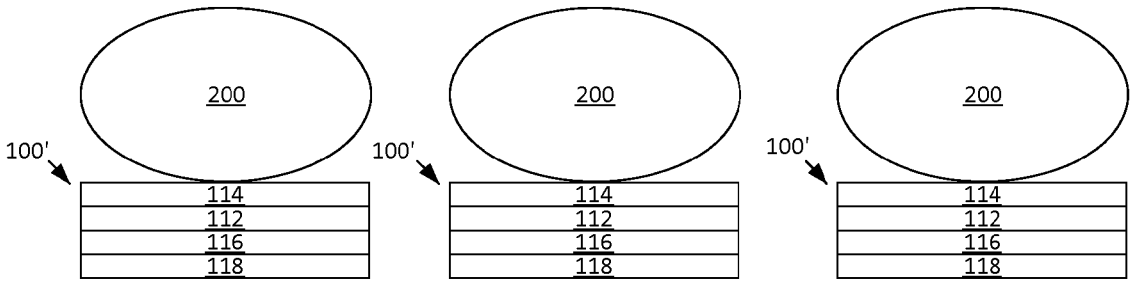

FIGS. 5 and 6 illustrate applying cut labels to a plurality of target substrates.

It has been found that the present assemblies provide a label assembly that reduces the relevance or importance of the label stiffness in dispensing and applying the label to a surface.

The material for the tack varnish layer 118 can comprise a no slip or non-skid varnish that has a relatively low concentration of slip additives and/or no anti-blocking agents such as polyethylene and waxes. The tack varnish layer 118 may be selected from varnishes, including, but not limited to those used in the manufacture of soft touch labels. In other embodiments, the tack varnish layer 118 can comprise a water-based adhesive generally referred to in the art as a "cold glue" adhesive.

Water-based adhesives that are useful as the tack varnish layer may include any of the water-based adhesives known to be useful for labeling of substrates such as glass, plastics, and metal such as adhesives based on starch, modified starches, casein, synthetic polymers, or blends of starch, modified starches, casein or synthetic polymers, or a combination of two or more thereof. In one embodiment, the cold glues may comprise polymer emulsions or micro-emulsions such as synthetic emulsions, e.g., an emulsion based on acrylic polymers or vinyl acetate polymers and usually copolymers such as vinyl acetate/ethylene or vinyl acetate/maleic acid, and styrene/acrylic copolymers. The water based adhesive also may be an emulsion based on a modified natural latex (e.g., styrene-butadiene rubber, neoprene-butadiene rubber, and acrylate-butadiene rubber). These dispersions or emulsions can optionally be modified by the addition of various synthetic and natural resins and additives such as casein, modified starch, polymers in solution, rosin compounds, rheological agents, etc., which provide specific properties in terms of flow, anchorage, tackiness, speed of drying, clarity, water resistance, etc. In one embodiment, these water-based emulsion adhesives generally will have solids content of at least 40%. The water-based adhesive based on casein or dextrin generally have a lower solids content (20 to 30%). The use of water-based adhesives requires that drying must take place by evaporation of the water. The drying process is assisted when the emulsions contain higher solids contents such as at least 50% and, especially around 60%. Solids content generally does not exceed 65 or 70% by weight.

The facestock layer 112 that is used in the label assembly 100 is generally not limited and may comprise any of a variety of materials known to those skilled in the art to be suitable as a facestock material. For example, the facestock layer 112 may be comprised of such materials as paper (e.g., kraft, bond, offset, litho, and sulfite paper) with or without sizing, or polymeric materials suitable for the facestock layer 112 use such as polyolefins, polyesters, polyamides, etc. In one embodiment, the requirement for the facestock material is that it be capable of forming some degree of adhesive bond to an adhesive layer 114. In another embodiment, the facestock layer 112 may comprise a polymeric film that may form the desired bond and is capable of being printed. In yet another embodiment, the polymeric film material is one that, when combined with the adhesive layer 114, provides a sufficiently self-supporting construction to facilitate label dispensing (label separation and application). The surfaces of the facestock layer 112 may be surface treated, such as, for example, corona treated, flame treated, or top coat treated to improve performance in various areas such as printability, adhesion to the adhesive layer 114 in contact with the facestock layer 112, etc. In one embodiment, the polymer film material is chosen to provide the label assembly 100 with one or more of the desired properties such as printability, die-cuttability, matrix-strippability, dispensability, etc.

The facestock may be a monolayer polymeric film facestock or it may comprise more than one polymer film layer, some of which may be separated by an internal adhesive layer. The thicknesses of each of the layers may be varied. Multilayer film facestocks may be prepared by techniques known to those skilled in the art such as by laminating two or more preformed polymeric films (and, optionally an adhesive layer 114) together, or by the coextrusion of several polymeric films and, optionally, an adhesive layer 114. The multilayer facestocks may be prepared also by sequential coating and formation of individual layers, triple die coating, extrusion coating of multiple layers onto an adhesive layer 114, etc.

The facestock layer 112 may have a thickness of from about 0.25 mils (0.0064 mm) to about 10 mils (0.26 mm); about 1 mil (0.026 mm) to about 7.5 mils (0.19 mm); even about 2 mils (0.051 mm) to about 5 mils (0.13 mm). Here, as elsewhere in the specification and claims, numerical values may be combined to form new and non-disclosed ranges.

The label assembly 100 also includes an adhesive layer 114 having an upper surface and a lower surface wherein the upper surface of the adhesive layer 114 is adhesively joined or adhered to the lower surface of the facestock layer 112. In some embodiments, as noted above, the label assembly configurations 100 and 100' also contain an interior adhesive that may function as a lamination adhesive when laminating preformed polymeric films together to form the facestock layer 112. The internal adhesives may be a heat-activated adhesive, hot melt adhesive, or pressure sensitive adhesives (PSA). In one embodiment, the external (adhered to the facestock layer 112) adhesive is a PSA. Adhesives that are tacky at any temperature up to about 160° C. (about 320° F.) are particularly useful. PSAs that are tacky at ambient temperatures are particularly useful in the adhesive constructions of the present invention. Ambient temperatures include room temperature and may range from 5 to 80° C., 10 to 70° C., or 15 to 60° C.

The adhesives may generally be classified into the following categories: random copolymer adhesives such as those based upon acrylate and/or methacrylate copolymers, alpha-olefin copolymers, silicone copolymers, chloroprene/acrylonitrile copolymers, and the like; and block copolymer adhesives including those based upon linear block copolymers (i.e., A-B and A-B-A type), branched block copolymers, star block copolymers, grafted or radial block copolymers, etc., and natural and synthetic rubber adhesives. In one embodiment, the adhesive of the adhesive layer 114 is an emulsion acrylic-based pressure sensitive adhesive.

A description of useful pressure-sensitive adhesives may be found in Encyclopedia of Polymer Science and Engineering, Vol. 13. Wiley-Interscience Publishers (New York, 1988). Additional description of useful pressure-sensitive adhesives may be found in Encyclopedia of Polymer Science and Technology, Vol. 1, Interscience Publishers (New York, 1964).

The label stock includes a release liner section comprising the liner layer 122 with the release coating layer 124 disposed on a surface of the liner layer. The liner layer 122 may include, for example, papers, synthetic papers and plastic films. The papers include, for example, glassine paper and polyethylene laminated paper. The plastic films include, for example, films of plastics such as polyolefin resin of polyethylene resin, polypropylene resin or the like, polyester resin of polybutylene terephthalate resin, polyethylene terephthalate resin or the like, acetate resin, polystyrene resin and vinyl chloride resin. Examples of the release liner having the surface without applying a release agent include polyolefin resin film such as polyethylene resin film, polypropylene resin film and the like, and films obtained by laminating the polyolefin resin film on the paper or the other films. The release coating layer 124 that is used in the label assembly may comprise any of a variety of materials known to those skilled in the art to be suitable as a non-stick coating. Release liners for use in the present invention may be those known in the art. In general, useful release liners include polyethylene coated papers with a commercial silicone release coating, polyethylene coated polyethylene terephthalate films with a commercial silicone release coating, or cast polypropylene films that can be embossed with a pattern or patterns while making such films, and thereafter coated with a commercial silicone release coating. A particularly suitable release liner is kraft paper which has a coating of low density polyethylene on the front side with a silicone release coating and a coating of high density polyethylene on the back side. Other release liners known in the art are also suitable as long as they are selected for their release characteristics relative to the pressure sensitive adhesive chosen for use in the present invention. In one embodiment of the invention, the release liner has a moldable layer of polymer under the release coating. The moldable layer may be, for example, a polyolefin such as, but not limited to, polyethylene or polypropylene. The surface of the release layer of the release liner may have a textured finish, a smooth finish, or a patterned finish. The release layer may have a randomly microstructured surface such as a matte finish, or have a pattern of three-dimensional microstructures. The microstructures may have a cross-section which is made up of circles, ovals, diamonds, squares, rectangles, triangles, polygons, lines or irregular shapes, when the cross-section is taken parallel to the surface of the release surface.

In one embodiment, the release liner has a release coating on both sides; one side having a release coating of a higher release value than the release coating of the other side. The label stock can comprise a heavy weight liner or a thin, light weight liner. The thickness of the thin liner is less than the standard 2.5 mils (0.064 mm). The thickness of the liner can be less than 2.2 mils (0.060 mm), less than 2.0 mils (0.051 mm), less than 1.8 mils (0.042 mm), or less than 1.2 mils (0.030 mm).

In one embodiment, the liner is an ultrathin or ultra light liner having a thickness of less than 1.02 mil (0.0254 mm), less than 1 mil (0.0254 mm), less than 0.92 mil (0.0233 mm), less than 0.8 mil (0.0203 mm), less than 0.6 mil (0.017 mm), less than 0.50 mil (0.013 mm), or equal to or less than 0.25 mil (0.00626 mm) Such thin liners are commercially available as HOSTAPHAN® polyester film (e.g., 0.5 mil, 0.0127 mm, tradename 2SLK silicone coated film) sheeting from Mitsubishi Chemical Company. Another liner material is provided by Avery Dennison as a 1.02 mil (0.026 mm) polyester backing sheet with a 1.25 mil (0.032 mm) adhesive layer.

The tack coating layer 126 that is used in the label assembly is chosen to provide the desired bonding with the tack varnish layer 118. For example, the tack coating layer 126 may be a tackified polymer. Examples of suitable materials include extrudates of known cling/protect film polymers, such as polyolefin elastomer, and styrenic based elastomers, etc., e.g., EXXONMOBIL™ VISTAMAXX™ and MISTUI™ TAFMER™. In one embodiment, the tack coating material comprises a low density tack coating. In another embodiment, the tack coating layer 126 can be a low hardness material, e.g. Shore A hardness of less than about 60, less than about 50, even less than about 40. In one embodiment, the tack coating layer 126 is a material having a Shore A hardness of from about 20 to about 60; about 25 to about 50; even about 30 to about 40.

The tack coating layer 126 may utilize a low density polyolefin and preferably, a propylene and/or ethylene based elastomer. In some embodiments, the polyolefin-based elastomer comprises at least one polymer formed from one olefin, or at least one polymer formed from one olefin where the polymer is a block copolymer, for example, a block copolymer having at least one isotactic or syndiotactic polypropylene block and at least one atactic polypropylene block. In one embodiment, the polyolefin-based elastomer comprises at least one copolymer formed from two or more olefins, and comprising a random copolymer, a block copolymer having at least two polymer blocks, or a mixture of two or more of any of the foregoing copolymers. In one embodiment, the polyolefin-based elastomer random copolymer comprises a random copolymer formed from at least a first alkene and at least a second alkene or diene where the content of the second alkene or diene in the random copolymer on a mole basis is 25% or less to include, for example, a linear low density polyethylene having a density of greater than 0.912 up to 0.94 g/cm$^3$ and formed from a major amount of ethylene and a minor amount of at least one other alpha-olefin, and a butyl rubber formed from a major amount of isobutylene and a minor amount of isoprene; a random copolymer formed from at least two alkenes where the two alkenes are generally present in the random copolymer in equimolar amounts to include, for example, an ethylene-propylene rubber, and an ethylene-propylene-diene monomer elastomer which additionally contains a minor amount of a nonconjugated diene; or a mixture of two or more of any of the foregoing random copolymers. In one embodiment the polyolefin-based elastomer block copolymer comprises a block copolymer formed from at least two alkenes and having at least one homopolymer segment bonded to at least one copolymer segment to include, for example, a propylene-ethylene-based block copolymer containing at least one polypropylene homopolymer segment and at least one propylene-ethylene copolymer segment, and an ethylene-alpha-olefin-based block copolymer containing at least one polyethylene homopolymer segment and at least one ethylene-alpha-olefin copolymer segment; a block copolymer formed from at least one linear diene and at least one branched diene and having at least one homopolymer segment from the linear diene bonded to at least one homopolymer segment from the branched diene, to include, for example, a hydrogenated butadiene-isoprene-butadiene triblock copolymer; or a mixture of two or more of any of the foregoing block copolymers. In one embodiment, the polyolefin-based elastomer comprises a block copolymer formed from at least two alkenes, as described hereinabove, where the block copolymer has its crystalline size in the nanometer level which provides improved properties compared to conventional elastomers which have their crystalline size in the micrometer level. Polyolefin-based elastomer block copolymers are further described in U.S. Pat. Nos. 3,985,826; 5,708,083; and 6,812,292. Useful elastomeric organic polymers are commercially available and include a polyolefin-based elastomer NOTIO™ PN-2070 (a propylene-ethylene block copolymer with crystalline size in the nanometer level) from Mitsui Chemicals which has an ASTM D 792 density of 0.867 g/cm$^3$, an ASTM D 1238 melt flow rate at 230° C./2.16 kg of 7 dg/minute, an ASTM D 882 elongation at break of greater than 800%, an ASTM D 882 tensile modulus in machine and transverse directions of 16 MPa, an ASTM D 882 tensile strength at break in machine and transverse directions of 14 MPa; a polyolefin-based elastomer VISTAMAXX™ VM1100 (a propylene-ethylene-based random copolymer) from ExxonMobil which has an ASTM D 792 density of 0.862 g/cm$^3$ and an ASTM D 1238 melt flow rate at 230° C./2.16 kg of 4 dg/minute; and a vinyl arene-based block copolymer elastomer VECTOR™ 4114A (a SIS/SI blend of block copolymers) from Dexco Polymers which has an ASTM D 792 density of 0.92 g/cm$^3$ and an ASTM D 1238 melt flow rate at 200° C./5 kg of 25 dg/minute.

A wide array of commercially available polyolefin elastomers can be used for the tack coating layer 126 including those sold under the tradenames KRATON™, VECTOR™, and AFFINITY™. Representative examples of suitable materials include KRATON™ D1164P and G2832 available from Kraton Polymers US, LLC of Houston, Tex.; DOW™ AFFINITY DG8200 and DOW™ VERSIFY 3200 and 3000 from Dow Chemical Corp. of Midland, Mich.; DYNAFLEX™ G2755 from GLS Corp. of McHenry, Ill.; SEPTON™ 2063 from Kuraray of Tokyo, Japan; and VISTAMAXX™ VMIIOO from Exxon Mobil Chemical Co. of Houston, Tex.

The adhesive label (i.e., the facestock layer and adhesive layer(s)) can have a stiffness as desired for a particular purpose or intended application. Stiffness can be evaluated in any suitable manner now known or later discovered. The label stiffness can be given in terms of its ISO (International Organization for Standardization) 2493 bending resistance (at 15°) which is expressed in milliNewtons (mN). Bending can be evaluated using a L & W bending tester. In one embodiment, the adhesive label has a stiffness of from about 2 mN to about 20 mN; from about 5 mN to about 17 mN; from about 7 mN to about 15 mN; even from about 10 mN to about 12 mN. In one embodiment, the adhesive labels can have a stiffness of less than about 10 mN; less than about 8 mN; less than about 6 mN; even less than about 5 mN. In another embodiment, the adhesive labels can have a stiffness of from about 2 mN to about 10 mN; from about 4 mN to about 8 mN; even from about 5 mN to about 7 mN. Here as elsewhere in the specification and claims, numerical values can be combined to form new and non-disclosed ranges. The present label assemblies and methods of using the same allow for the effective dispensing or application of labels having a relatively low stiffness (e.g., below 10 mN) without the issues or problems associated with conventional peel-plate methods.

As would be appreciated by those of skill in the art, the label assembly 100 may be formed by any suitable process, including, but not limited to, one or more printing processes (either single or multilayer printing processes) wherein each of the layers of the label assembly 100 are formed in an individual printing process and then are joined with one or more additional sub-components of label structure where such sub-components themselves may comprise one or more additional layers of label structure. In another embodiment, one or more layers of label structure can be formed by a suitable extrusion process, coating process, or other process.

Figure 7:
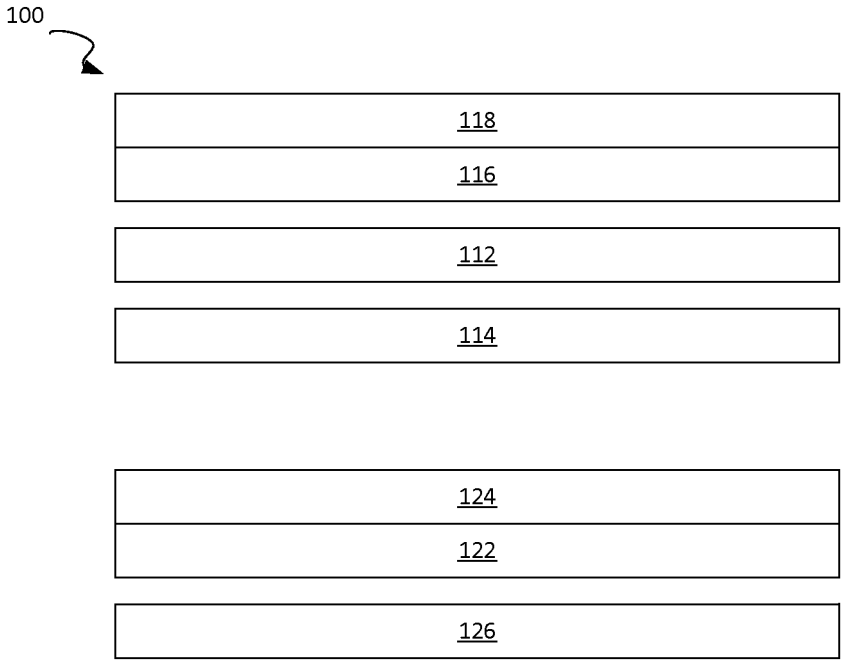
FIG. 7 is a sectional view of a cross-section illustration of the first stage of label assembly according to one embodiment of the present invention.
Figure 8:
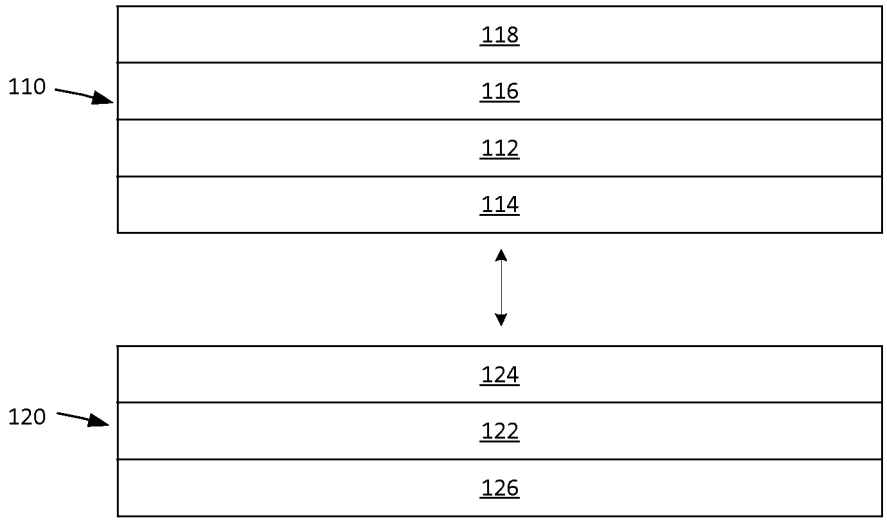
FIG. 8 is a sectional view of a cross-section illustration of the second stage of label assembly according to one embodiment of the present invention.

A non-limiting example of a suitable process for forming a label assembly 100 is shown in FIGS. 7 and 8. In this embodiment, the label section 110 can be formed by applying the print layer 116 to the facestock layer 112 and applying a tack varnish layer 118 to the print layer 116. The adhesive layer 114 can then be applied to the facestock layer 112 to form the label section 110 (FIG. 8). It will be appreciated that the various layers could be applied to one another in a different manner to provide the label section. For example, the adhesive layer 114 can be applied to the facestock layer 112 prior to applying the print layer 116 and the tack varnish layer 118.

The liner section 120 can be assembled by providing the liner layer 126 having the release coating 124 disposed on an upper surface of the liner layer 126 and applying a tack coating layer 126 to the lower surface of the liner layer 126.

The labels may be cut by any suitable process or cutting device and system. In one embodiment, the cutting process is performed without removing the liner prior to die-cutting the labels. In another embodiment, the liner may be temporarily removed and a temporary support may be applied to the adhesive. The support may be removed after die-cutting and the label reapplied. The labels may be created by a roll to roll labeling process which does not require peel plates as the label can have intimate contact with target substrate 200. The newly labeled target substrate 200 can be wiped down with a sponge or wiper blade after label application to smooth the label.

It may be practical to coat the reverse side of the liner with a cold seal adhesive (CSA), and use a printable cold seal adhesive (e.g. Ashland's Pureseal 23322E) as the final printer layer. As cold seal adhesives only tack to themselves, this would not affect other processing steps. The strength of the CSA may be tailored to meet the strength requirements to pull the label from the liner while being low enough to release the bond of container.

While the invention has been described in relation to various aspects and embodiments, it is appreciated that various modifications may become apparent to those skilled in the art upon reading the specification. The subject matter described herein is intended to cover such modifications as fall within the scope of the appended claims.

What is claimed is:

1. A label assembly having a first configuration comprising:

a facestock layer having an upper surface and a lower surface;

an adhesive layer having an upper surface and a lower surface, the upper surface of the adhesive disposed adjacent to the lower surface of the facestock layer;

a tack varnish layer overlying the upper surface of the facestock layer;

a liner assembly comprising a release liner overlying the adhesive layer, the release liner comprising a liner layer having an upper surface and a lower surface, the upper surface comprising a release coating layer, the release coating layer being disposed adjacent to the adhesive layer; and a tack coating layer overlying the lower surface of the liner layer, wherein when wound in a roll, the tack coating layer is disposed adjacent to the tack varnish layer; and wherein a bond force between the tack coating layer and the tack varnish layer is greater than a bond force between the adhesive layer and the release coating layer, such that when the roll is unwound, the label assembly has a second configuration from the top down of:

the adhesive layer;

the label facestock;

the tack varnish layer;

the tack coating layer;

the liner layer; and the release coating layer.

2. The label assembly of claim 1, wherein the tack varnish layer comprises a material chosen from a non-skid varnish, a water-based adhesive, or a combination thereof.

3. The label assembly of claim 2, wherein the water-based adhesive comprises an adhesive based on starch, modified starches, casein, synthetic polymers, or a combination of two or more thereof.

4. The label assembly of claim 1, wherein the tack varnish layer comprises a material chosen from a polymer emulsion, a micro-emulsion, an, emulsion based on an acrylic polymer, an emulsion based on a vinyl acetate polymer, a vinyl acetate, a vinyl ethylene, a vinyl maleic acid, a styrene copolymer, an acrylic copolymer, an emulsion based on a modified natural latex, or a combination of two or more thereof.

5. The label assembly of claim 1, wherein the tack coating layer comprises a material chosen from a tackified polymer, a polyolefin elastomer, a styrenic based elastomer, a low density tack coating, and a low hardness material.

6. The label assembly of claim 1, wherein, when applied to a target substrate, the adhesive exhibits a bond force with the target substrate that is greater than a bond force between the tack varnish layer and the tack coating layer such that the liner assembly is detachable from the label assembly.

7. The label assembly of claim 6, wherein the release liner is detached from the adhesive layer, the facestock layer, and the tack varnish layer.

8. The label assembly of claim 1, wherein the facestock comprises a print layer.

9. The label assembly of claim 1, wherein the facestock layer comprises a material chosen from a polyolefin, a polyester, a polyamide, and a paper.

10. The label assembly of claim 1, wherein the adhesive layer comprises a material chosen from a copolymer adhesive, a block copolymer adhesive, a branched block copolymer, a star block copolymer, a grafted copolymer, and a radial block copolymer.

11. The label assembly of claim 1, wherein the release coating layer comprises a material chosen from a polyethylene coated paper with a commercial silicone release coating, a polyethylene coated polyethylene terephthalate film with a commercial silicone release coating, and a cast polypropylene film.

12. The label assembly of claim 1, wherein the liner layer comprises a material chosen from a glassine paper, a polyethylene laminated paper, a polyolefin resin film, a polyethylene resin film, a polypropylene resin film, a polyester resin of polybutylene terephthalate resin film, a polyethylene terephthalate resin film, an acetate resin film, a polystyrene resin film, a vinyl chloride resin film, a polyethylene resin film, and a polypropylene resin film.

13. The label assembly of claim 1, wherein the label assembly has a stiffness of about 2 mN to about 20 mN.

14. The label assembly of claim 1, wherein the label assembly has a stiffness of about 7 mN to about 15 mN.

15. The label assembly of claim 1, wherein the label assembly has a stiffness of less than about 10 mN.

16. A label assembly comprising:

a release liner, the release liner comprising a liner layer having an upper surface and a lower surface, the upper surface disposed adjacent to a release coating layer, and a tack coating layer disposed adjacent to the lower surface of the liner layer;

a facestock layer underlying the liner layer, the facestock layer having an upper surface and a lower surface;

an adhesive layer underlying the liner layer, the adhesive layer having an upper surface and a lower surface, the upper surface of the adhesive disposed adjacent to the lower surface of the facestock layer;

a tack varnish layer overlying the upper surface of the facestock layer and disposed adjacent to the tack coating layer, wherein a surface of the adhesive layer contacts a target substrate surface, where a bond force between the target substrate and the adhesive layer is greater than the bond force between the tack coating layer and the tack varnish layer, such that the liner assembly is detachable from the label assembly.

17. The label assembly of claim 16, wherein the tack varnish layer comprises a material chosen from a non-skid varnish, a water-based adhesive, or a combination thereof.

18. The label assembly of claim 17, wherein the water-based adhesive comprises an adhesive based on starch, modified starches, casein, synthetic polymers, or a combination of two or more thereof.

19. The label assembly of claim 16, wherein the tack varnish layer comprises a material chosen from a polymer emulsion, a micro-emulsion, an, emulsion based on an acrylic polymer, an emulsion based on a vinyl acetate polymer, a vinyl acetate, a vinyl ethylene, a vinyl maleic acid, a styrene copolymer, a acrylic copolymer, an emulsion based on a modified natural latex, or a combination of two or more thereof.

20. The label assembly of claim 16, wherein the tack coating layer comprises a material chosen from a tackified polymer, a polyolefin elastomer, a styrenic based elastomer, a low density tack coating, and a low hardness material.

21. The label assembly of claim 16, wherein the facestock layer is printed.

22. The label assembly of claim 16, wherein the facestock layer comprises a material chosen from a polyolefin, a polyester, a polyamide, and a paper.

23. The label assembly of claim 16, wherein the adhesive layer comprises a material chosen from a copolymer adhesive, a block copolymer adhesive, a branched block copolymer, a star block copolymer, a grafted copolymer, and a radial block copolymer.

24. The label assembly of claim 16, wherein the release coating layer comprises a material chosen from a polyethylene coated paper with a commercial silicone release coating, a polyethylene coated polyethylene terephthalate film with a commercial silicone release coating, and a cast polypropylene film.

25. The label assembly of claim 16, wherein the liner layer comprises a material chosen from a glassine paper, a polyethylene laminated paper, a polyolefin resin film, a polyethylene resin film, a polypropylene resin film, a polyester resin of polybutylene terephthalate resin film, a polyethylene terephthalate resin film, an acetate resin film, a polystyrene resin film, a vinyl chloride resin film, a polyethylene resin film, and a polypropylene resin film.

26. The label assembly of claim 16, wherein the label assembly has a stiffness of about 2 mN to about 20 mN.

27. The label assembly of claim 16, wherein the label assembly has a stiffness of about 7 mN to about 15 mN.

28. The label assembly of claim 16, wherein the label assembly has a stiffness of less than about 10 mN.

29. The method for applying a label to a substrate comprising:

(a) providing a label assembly having a first configuration comprising:

a facestock layer having an upper surface and a lower surface;

an adhesive layer having an upper surface and a lower surface, the upper surface of the adhesive disposed adjacent to the lower surface of the facestock layer;

a tack varnish layer overlying the upper surface of the facestock;

a liner assembly comprising a release liner overlying the adhesive layer, the release liner comprising a liner layer having an upper surface and a lower surface, the upper surface comprising a release coating layer, the release coating layer being disposed adjacent to the adhesive layer; and a tack coating layer overlying the lower surface of the liner layer; the label assembly being wound into a roll such that the tack varnish layer contacts the tack coating layer; wherein a bond force between the tack coating layer and the tack varnish layer greater than a bond force between the release coating layer and the adhesive;

(b) unwinding the label assembly where the bond force between the tack coating layer and the tack varnish layer results in a release of the bond between the adhesive layer and the low release coating layer such that the adhesive layer is facing outward; and (c) contacting a surface of the adhesive layer with a target substrate surface, where a bond force between the target substrate and the adhesive layer greater than the bond force between the tackcoating layer and the tack varnish layer, such that the liner assembly is detachable from the label assembly.

30. The method of claim 29, further comprising (d) detaching the liner from the label assembly.

31. The method of claim 29, wherein the label assembly has a stiffness of about 2 mN to about 20 mN.

32. The method of claim 29, wherein the label assembly has a stiffness of about 7 mN to about 15 mN.

33. The method of claim 29, wherein the label assembly has a stiffness of less than about 10 mN.

* * * * *